US008522527B2

(12) United States Patent
Eroglu et al.

(10) Patent No.: US 8,522,527 B2
(45) Date of Patent: Sep. 3, 2013

(54) BURNER FOR A GAS TURBINE AND METHOD FOR FEEDING A GASEOUS FUEL IN A BURNER

(75) Inventors: Adnan Eroglu, Untersiggenthal (CH); Douglas Anthony Pennell, Windisch (CH); Johannes Buss, Hohberg (DE); Richard Smith, Ennetbaden (CH)

(73) Assignee: ALSTOM Technology Ltd., Baden (CH)

( * ) Notice: Subject to any disclaimer, the term of this patent is extended or adjusted under 35 U.S.C. 154(b) by 565 days.

(21) Appl. No.: 12/690,283

(22) Filed: Jan. 20, 2010

(65) Prior Publication Data

US 2010/0192591 A1 Aug. 5, 2010

(30) Foreign Application Priority Data

Jan. 23, 2009 (EP) ..... 09151280

(51) Int. Cl.

| | |
|---|---|
| ***F02K 3/10*** | (2006.01) |
| ***F02C 1/06*** | (2006.01) |
| ***F02C 1/00*** | (2006.01) |
| ***F02C 7/22*** | (2006.01) |

(52) U.S. Cl.
USPC ..... 60/241; 60/39.17; 60/740; 60/776

(58) Field of Classification Search
USPC ..... 60/39.17, 737, 241, 740, 742, 776
See application file for complete search history.

(56) References Cited

U.S. PATENT DOCUMENTS

| | | | | |
|---|---|---|---|---|
| 4,763,481 | A * | 8/1988 | Cannon | 60/737 |
| 4,850,194 | A * | 7/1989 | Fuglistaller et al. | 60/737 |
| 5,487,659 | A | 1/1996 | Eroglu et al. | |
| 5,593,302 | A | 1/1997 | Althaus et al. | |
| 2002/0069645 | A1 * | 6/2002 | Mowill | 60/776 |
| 2003/0093997 | A1 | 5/2003 | Stalder et al. | |

FOREIGN PATENT DOCUMENTS

| | | |
|---|---|---|
| DE | 19643715 | 4/1998 |
| EP | 0595026 | 5/1994 |
| EP | 1030109 | 8/2000 |
| EP | 1752709 | 2/2007 |
| FR | 1146374 | 11/1957 |

OTHER PUBLICATIONS

European Search Report for EP Patent App. No. 09151280.6 (Jul. 10, 2009).

* cited by examiner

*Primary Examiner* — Gerald L Sung
(74) *Attorney, Agent, or Firm* — Cermak Nakajima LLP; Adam J. Cermak

(57) ABSTRACT

A burner (1) for a gas turbine includes a duct (2) enclosing a plurality of vortex generators (3) and, downstream of them, a lance (5) provided with nozzles (6) for injecting a gaseous fuel. The burner (1) also includes a mixer (7) for diluting and mixing the gaseous fuel with air to form a mixture. The mixer (7) is connected to the nozzles (6) for feeding them with the mixture. A method includes feeding the gaseous fuel in the burner (1).

11 Claims, 2 Drawing Sheets

BURNER FOR A GAS TURBINE AND METHOD FOR FEEDING A GASEOUS FUEL IN A BURNER

This application claims priority under 35 U.S.C. §119 to European Application No. 09151280.6, filed 23 Jan. 2009, the entirety of which is incorporated by reference herein.

BACKGROUND

1. Field of Endeavor

The present invention relates to a burner for a gas turbine and a method for feeding a gaseous fuel into a burner.

2. Brief Description of the Related Art

In particular, the present invention relates to a sequential combustion gas turbine, i.e., a gas turbine having a compressor which generates a main flow of compressed air and feeds it to a first burner, wherein a fuel is injected to form a mixture.

The mixture is combusted in a combustion chamber and is expanded in a high pressure turbine. The hot gases (which come out from the high pressure turbine and are still rich in oxygen) are then fed to a second burner, wherein a further fuel is injected to form a mixture that is combusted in a second combustion chamber to generate hot gases that are expanded in a low pressure turbine.

In particular, the present invention can relate to the second burner.

As known in the art, the temperature of the hot gases going out from the second combustion chamber allows a good efficiency and, at the same time, also low NOx emissions to be achieved.

Nevertheless, in order to increase the efficiency of the gas turbines, the temperature of the hot gases going out from the second combustion chamber should be increased.

Increasing the temperature in the second combustion chamber inevitably causes an increase of the NOx emissions that, on the contrary, should be kept as low as possible.

SUMMARY

One of numerous aspects of the present invention therefore includes a burner and a method by which the problems of the known art are addressed.

Another aspect of the present invention include a burner and a method by with the overall efficiency of the sequential gas turbine is increased but, at the same time, the NOx emissions are kept at a low level.

In particular, the temperature of the flame within the second combustion chamber is increased but the NOx emissions are kept almost at the same level as traditional sequential combustion gas turbines or are increased up to an acceptable level.

Advantageously, burners embodying principles of the present invention have a structure that is much simpler and also much cheaper than that of traditional burners.

BRIEF DESCRIPTION OF THE DRAWINGS

Further characteristics and advantages of the invention will be more apparent from the description of a preferred, but non-exclusive, embodiment of the burner and method according to the invention, illustrated by way of non-limiting example in the accompanying drawings, in which.

DETAILED DESCRIPTION OF EXEMPLARY EMBODIMENTS

With reference to the figures, these show a burner for a gas turbine overall indicated by the reference number 1.

Figure 1:
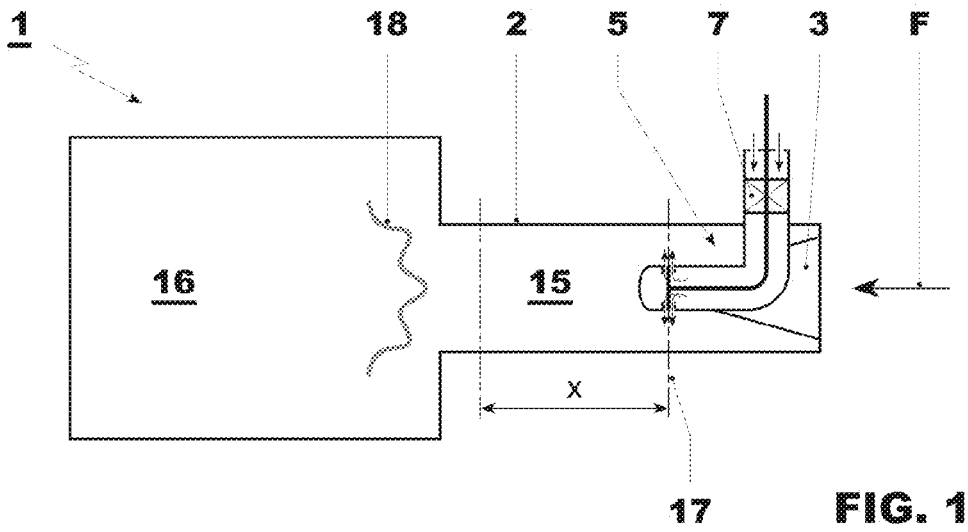
FIG. 1 schematically shows a burner according to the invention.
Figure 2:
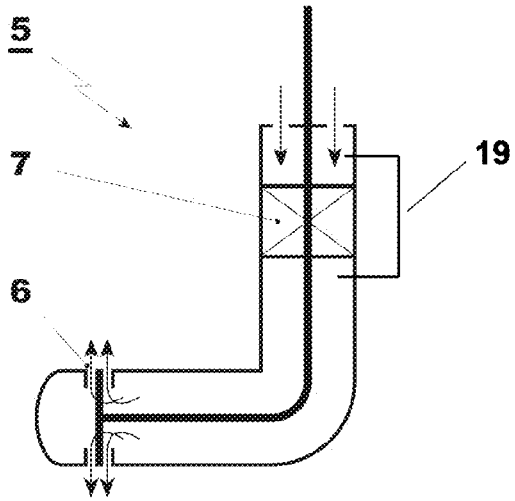
FIG. 2 shows a lance of the burner according to the invention.
Figure 3:
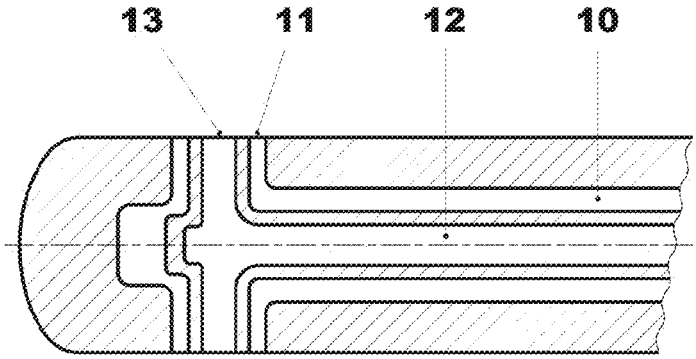
FIG. 3 shows a particular of the nozzles of the lance of FIG. 2.

The burner 1 is the second burner of a sequential combustion gas turbine and includes a duct 2 having a rectangular, square, or trapezoidal shape and enclosing a plurality of vortex generators 3; typically the vortex generators 3 are four in number and are placed on the four walls of the duct 2 (for sake of clarity only one vortex generator is shown in FIG. 1).

Downstream of the vortex generators 3, the burner 1 includes a lance 5 provided with nozzles 6 for injecting a gaseous fuel and/or a liquid fuel.

Downstream of the lance 5 the burner 1 has a mixing zone 15 followed by a combustion chamber 16 where combustion occurs.

In addition, the burner 1 includes a mixer 7 for diluting and mixing the gaseous fuel with an oxidiser (typically air) to form a mixture.

For example the mixer 7 is a static mixer that could be integrated into the lance.

The mixer 7 is connected to the nozzles 6 for feeding the same nozzles 6 with the mixture to be injected.

Preferably the mixer 7 is located outside the duct 2.

In particular, the lance 5 includes a first pipe 10 connecting the mixer 7 to a first aperture 11 of the nozzles 6 and a second pipe 12 connecting a liquid fuel feeding to a second aperture 13 of the nozzles 6.

As shown in the figures, the first aperture 11 of the nozzles 6 and the second aperture 13 of the nozzles 6 are coaxial, the first aperture 11 being annular in shape and encircling the second aperture 13.

In the same manner, also the first pipe 10 is annular in shape and encircles the second pipe 12.

Preferably the burner (or the lance) is provided with a by-pass 19 in parallel to the mixer 7, such that at least the air can be fed to the mixer or (via the by-pass) directly to the first pipe 10.

The operation of the burner 1 is apparent from that described and illustrated and is substantially the following.

The hot gases F coming from the high pressure turbine enter the duct 2 and pass through it; thus (within the duct 2) a fuel is injected within the hot gases to form the mixture to be combusted in the combustion chamber 16. Reference numeral 18 indicates the flame front.

The burner may alternatively operate with liquid fuel (oil) or gaseous fuel.

Operation with Liquid Fuel

The liquid fuel is fed through the second pipe 12 to the second aperture 13 of the nozzles 6; at the same time shielding air is fed through the first pipe 10 to the first aperture 11 of the nozzles 6.

Preferably the shielding air passes through the by-pass to enter the first pipe 10 without passing through the mixer 7 in order to avoid unnecessary pressure drops.

Thus, during operation with liquid fuel, injection occurs in the traditional way, with a central liquid fuel jet encircled by an annular shielding air jet.

Operation with Gaseous Fuel

Both gaseous fuel and air are fed to the mixer 7 where gaseous fuel is diluted and is mixed with air to form a mixture.

This mixture is then fed to the first aperture 11 of the nozzles 6 through the first pipe 10; in this case, the mixture of gaseous fuel and air is injected without an annular shielding air jet encircling it.

Tests showed that injection of a mixture flow of gaseous fuel and air without a shielding air encircling it let penetration of the mixture flow within the hot gases flowing in the duct be increased.

A burner embodying principles of the invention let the NOx emissions of a gas turbine operating at high temperature (i.e., with a flame temperature in the second combustion chamber higher than the flame temperature in the second combustion chamber of traditional gas turbines) be kept to almost the same values of traditional gas turbines or be increased up to acceptable values.

Figure 4:
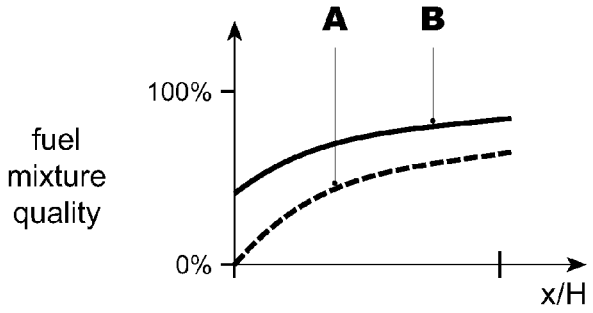
FIG. 4 is a diagram showing schematically the mixture quality within the burner with traditional burners (curve A) and with the burner of the invention (curve B)

In this respect, FIG. 4 shows the fuel mixture quality; in this diagram, x is the distance of a generic cross section of the burner from the injection plane 17 (i.e., the plane perpendicular to the axis of the burner and containing the nozzles 6), and H is the height of the duct.

This diagram shows that the mixing quality in the burner of the invention is much better than that of traditional burners.

In fact, in a burner embodying principles of the invention, when the gaseous fuel is injected in the duct 2, it has already been mixed with air to some extent and only a further mixing occurs, whereas in traditional burners all the mixing occurs after injection within the burner.

Figure 5:
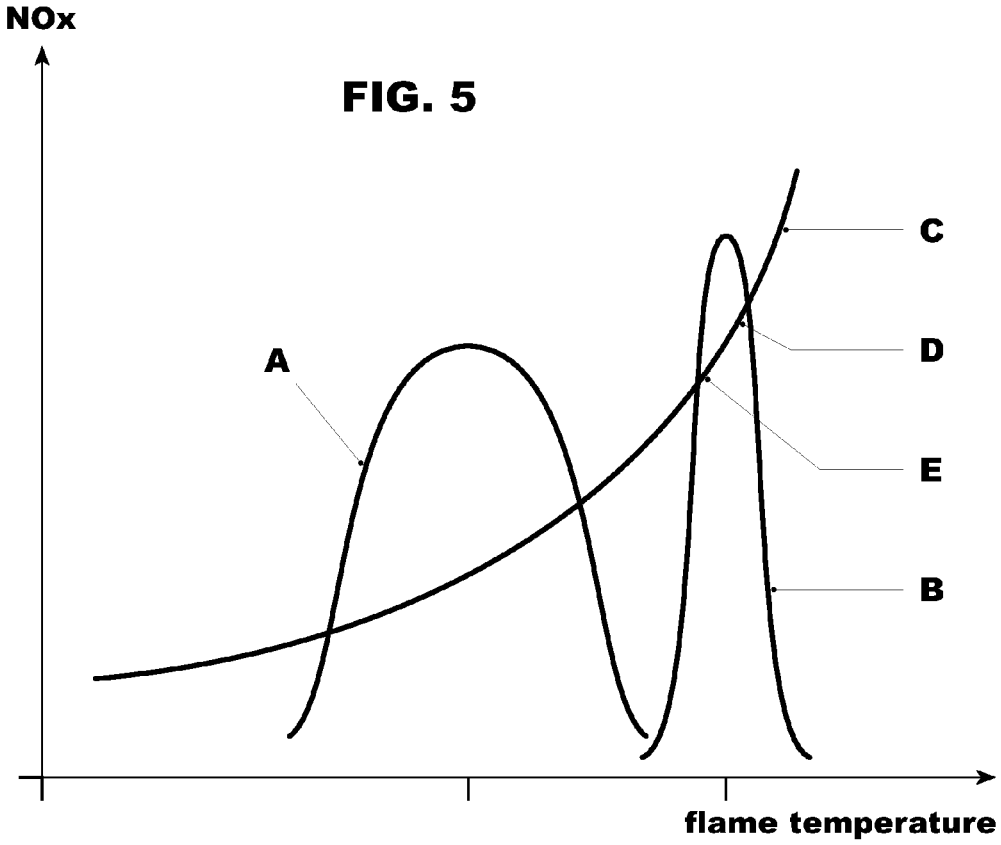
FIG. 5 is a diagram showing schematically the NOx emissions according to the temperature of the flame.

FIG. 5 shows that the NOx emissions increase exponentially with the temperature of the flame (curve C), meaning that for a small increase in the temperature of the flame, the NOx emissions have a huge increase.

Within the combustion chamber the temperature of the flame is not the same over the entire flame front, but it varies according to the mixing quality.

In this respect, curve A of FIG. 5 shows the Gaussian distribution of temperature in the combustion chambers which are fed by traditional burners; due to the not-optimized mixing quality, the distribution of the temperature is quite large; this distribution of temperatures directly influences the NOx emissions as shown in the diagram.

Curve B in the same diagram (that shows the Gaussian distribution of temperature in the combustion chambers which are fed by burners of the invention) shows that, when the temperature of the flame is increased, NOx emissions are much greater and they increase exponentially with the temperature of the flame (in fact curve B intercepts curve C in a zone with a greater slope).

Therefore in order to limit NOx emissions, the curve B is kept as narrow as possible; this is achieved improving the mixing quality of the gaseous fuel with air.

In fact, as the curve C describing the NOx emissions relative to the temperature of the flame is an exponential curve, higher emissions caused by the higher temperatures of the flame (i.e., the zone D) are not compensated for by lower emissions caused by lower temperatures of the flame (i.e., the zone E).

According to principles of the present invention, the curve B is as narrow as possible to limit the NOx emissions in the two zones D and E, because their balance is unfavorable for the NOx emissions.

In addition, even if the gaseous fuel is injected without the shielding air protecting it and letting it penetrate within the hot gases flowing within the duct to prevent auto ignition as soon as the gaseous fuel goes out from the nozzles, in a burner embodying principles of the invention, auto ignition does not occur because the fuel is injected already well mixed with the air and the delay time for such a well mixed mixture is sufficient to let the mixture penetrate and further mix with the hot gases within the duct 2.

Moreover, as the lance is only provided with two pipes (instead of three pipes as the lances of traditional burners), its structure is much easier and cheaper than that of traditional burners.

This structure of the lance also allows less inner disturbance of the exiting flow due to interaction between the shielding air and the hot gases and the ends of their respective pipes.

The present invention also relates to a method for feeding a gaseous fuel in a burner of a gas turbine.

According to a method in accordance with principles of the present invention, before the gaseous fuel is injected, it is mixed with an oxidizer (typically air) to form a mixture, which is injected in the duct 2 of the burner 1.

Advantageously the fuel is mixed with the oxidizer (air) in a weight ratio that lets a prefixed temperature of the mixture to be obtained at the injection, in order to prevent auto ignition of the mixture within the lance, i.e., before the mixture is injected.

In this respect, the weight ratio is about 1:1 (i.e., 1 Kg of gaseous fuel is mixed with 1 Kg of air).

The burner and the method conceived in this manner are susceptible to numerous modifications and variants, all falling within the scope of the inventive concept; moreover all details can be replaced by technically equivalent elements.

In practice the materials used and the dimensions can be chosen at will according to requirements and to the state of the art.

REFERENCE NUMBERS

1 burner
2 duct
3 vortex generators
5 lance
6 nozzles
7 mixer
10 first pipe
11 first aperture of the nozzles
12 second pipe
13 second aperture of the nozzles
15 mixing zone
16 combustion chamber
17 injection plane
18 flame front
19 By-pass
F hot gases
x distance of a generic cross section of the burner from the injection plane
A, B (FIG. 4) mixture quality
A, B, C, D, E (FIG. 5) NOx emissions according to the temperature of the flame
H height of the duct While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A burner for a gas turbine, the burner comprising:

a duct enclosing a plurality of vortex generators;

a lance downstream of the plurality of vortex generators, the lance comprising nozzles configured and arranged to inject at least a gaseous fuel;

a mixer comprising a mixing device arranged within the lance, said mixer configured and arranged to dilute and mix said gaseous fuel with an oxidizer to form a mixture, said mixer being connected to said nozzles for feeding the nozzles with the mixture;

a mixing zone downstream of the lance; and wherein said mixer is positioned outside said duct.

2. A burner as claimed in claim 1, wherein the nozzles comprise first and second apertures, and wherein said lance comprises at least a first pipe connecting said mixer to the first aperture of the nozzles and at least a second pipe connecting a liquid fuel feeding to the second aperture of the nozzles.

3. A burner as claimed in claim 2, wherein said first aperture of the nozzles and said second aperture of the nozzles are coaxial, and wherein the first aperture is annular and encircles the second aperture.

4. A burner as claimed in claim 2, wherein the first pipe is annular and encircles the second pipe.

5. A burner as claimed in claim 1, further comprising:

a by-pass parallel to the mixer.

6. A sequential gas turbine comprising:

first and second burners;

wherein the second burner is a burner as claimed in claim 1; and wherein the oxidizer is air.

7. A burner as claimed in claim 1, further comprising:

a source of gaseous fuel and a source of oxidizer;

wherein the mixer is in fluid communication with the source of gaseous fuel and with the source of oxidizer.

8. A method for feeding a gaseous fuel in a burner of a gas turbine, the method comprising:

providing a burner with a duct and a mixer according to claim 1;

mixing a gaseous fuel with an oxidizer to form a mixture outside of the duct of the burner;

feeding the mixture from the mixer to a nozzle; and thereafter injecting the mixture in the duct into a hot gas flow for further mixing in the duct such that the mixture auto ignites.

9. A method according to claim 8, wherein mixing comprises mixing said gaseous fuel with the oxidizer in a weight ratio that permits a prefixed temperature of the mixture to prevent auto ignition of the mixture within the lance to be obtained at injection.

10. A method according to claim 9, wherein said weight ratio is 1:1.

11. A method according to claim 8, wherein the oxidizer is air.

* * * * *